US012569017B2

(12) United States Patent
Kozuki et al.

(10) Patent No.: US 12,569,017 B2
(45) Date of Patent: Mar. 10, 2026

(54) GLOVE

(71) Applicant: SHOWA GLOVE CO., Hyogo (JP)

(72) Inventors: Kodai Kozuki, Hyogo (JP); Sho Satake, Hyogo (JP)

(73) Assignee: SHOWA GLOVE CO., Hyogo (JP)

( * ) Notice: Subject to any disclaimer, the term of this patent is extended or adjusted under 35 U.S.C. 154(b) by 633 days.

(21) Appl. No.: 17/979,347

(22) Filed: Nov. 2, 2022

(65) Prior Publication Data

US 2023/0147390 A1 May 11, 2023

(30) Foreign Application Priority Data

Nov. 5, 2021 (JP) ..... 2021-181384

(51) Int. Cl.
*A41D 19/00* (2006.01)
*A41D 31/102* (2019.01)

(52) U.S. Cl.
CPC ..... *A41D 19/0058* (2013.01); *A41D 19/0006* (2013.01); *A41D 31/102* (2019.02); *A41D 2500/50* (2013.01)

(58) Field of Classification Search
CPC ..... A41D 19/0058; A41D 19/0006; A41D 31/102; A41D 2500/50
See application file for complete search history.

(56) References Cited

U.S. PATENT DOCUMENTS

| | | | | | |
|---|---|---|---|---|---|
| 6,016,570 | A * | 1/2000 | Vande Pol | ..... | A41D 19/0062 2/161.7 |
| 6,119,272 | A | 9/2000 | Tebbe | | |
| 2008/0034467 | A1 | 2/2008 | Chou et al. | | |
| 2013/0283499 | A1 | 10/2013 | Chou et al. | | |
| 2016/0304738 | A1 | 10/2016 | Wang | | |
| 2020/0178626 | A1 | 6/2020 | Kozuki et al. | | |
| 2021/0015188 | A1 | 1/2021 | Kozuki | | |

FOREIGN PATENT DOCUMENTS

| | | | | | |
|---|---|---|---|---|---|
| CN | 106047019 | A | 10/2016 | | |
| DE | 19632312 | A1 | 2/1998 | | |
| EP | 4176750 | B1 * | 7/2025 | ..... | A41D 31/102 |
| JP | 2004316013 | A | 11/2004 | | |
| JP | 2007514575 | A | 6/2007 | | |
| JP | 2009544868 | A | 12/2009 | | |
| JP | 2012107360 | A | 6/2012 | | |
| JP | 2015212448 | A | 11/2015 | | |
| JP | 2020090737 | A | 6/2020 | | |
| JP | 2021017666 | A | 2/2021 | | |
| JP | 7749218 | B2 * | 10/2025 | ..... | A41D 31/102 |

* cited by examiner

*Primary Examiner* — Sophie Hon
(74) *Attorney, Agent, or Firm* — The Webb Law Firm

(57) ABSTRACT

A glove includes a glove body configured to cover a hand of a wearer, in which the glove body includes an innermost layer including a matrix resin and cellulose particles and forming an inner surface of the glove. At least some of the cellulose particles are at least partially exposed from the inner surface. The innermost layer includes 7 mass parts or more and 45 mass parts or less of the cellulose particles based on 100 mass parts of the matrix resin, and is formed as a non-foamed layer, and the cellulose particles have an average particle size of 10 μm or more and 45 μm or less.

4 Claims, 4 Drawing Sheets

GLOVE

CROSS-REFERENCE TO RELATED APPLICATION

This application claims priority to Japanese Patent Application No. 2021-181384, filed Nov. 5, 2021, the disclosure of which is hereby incorporated by reference in its entirety.

BACKGROUND OF THE INVENTION

Field of the Invention

The present invention relates to a glove.

Description of Related Art

Conventionally used have been gloves having a function to suppress their inside from causing vapor perspiration, i.e., from becoming damp due to perspiration of a wearer having the gloves on for a long period of time (e.g., an hour). For example, JP 2007-514575 T describes a glove including a glove body configured to cover a hand of a wearer, in which the glove body includes a matrix resin such as an elastomer latex and a fiber material such as cotton, and includes an innermost layer forming an inner surface of the glove. JP 2007-514575 T also describes that the glove configured as above enables the innermost layer to absorb perspiration even when the wearer having the glove on for a long period of time perspires to thereby suppress vapor perspiration from occurring inside the glove, more specifically, enables the wearer to feel the inside of the glove remaining dry even after he or she has the glove configured as above on for an hour. Further, JP 2007-514575 T describes that the innermost layer formed as a foam layer can more sufficiently absorb perspiration of the wearer.

SUMMARY OF THE INVENTION

Technical Problem

JP 2007-514575 T describes that the glove configured as above enables the innermost layer to absorb perspiration of the wearer having the glove on for an hour to the extent that the wearer feels the inside of the glove remaining dry. However, it appears that the amount of perspiration increases when the wearer has the glove configured as above on for more than an hour. In the glove configured as above, therefore, there is possibility that the innermost layer fails to sufficiently absorb such a large amount of perspiration to the extent that the wearer feels the inside remaining dry. Even when a single-time wearing and removal of the glove is completed within an hour, the cumulative amount of perspiration absorbed by the innermost layer increases if the wearer repeatedly wears and removes the glove multiple times to increase the cumulative period of time causing the wearing time to exceed an hour. In this case, the innermost layer may also fail to sufficiently absorb perspiration. The innermost layer failing to sufficiently absorb perspiration causes vapor perspiration inside the glove due to perspiration not absorbed by the innermost layer, which is not preferable. However, no sufficient consideration appears to have been made on such a problem.

In view of the above problem, it is an object of the present invention to provide a glove capable of relatively suppressing vapor perspiration from occurring even when a relatively large amount of perspiration is produced in the glove.

Solution to Problem

A glove according to the present invention includes a glove body configured to cover a hand of a wearer, in which the glove body includes an innermost layer forming an inner surface of the glove, the innermost layer includes a matrix resin and cellulose particles, at least some of the cellulose particles are at least partially exposed from the inner surface, the innermost layer includes 7 mass parts or more and 45 mass parts or less of the cellulose particles based on 100 mass parts of the matrix resin, and is formed as a non-foamed layer, and the cellulose particles have an average particle size of 10 μm or more and 45 μm or less.

DESCRIPTION OF THE INVENTION

Hereinafter, a description will be given on a glove according to one embodiment of the present invention with reference to the drawings. The description hereinafter will be given on an example configuration in which a glove includes a glove body, and a cuff connected to the glove body and configured to cover a wrist and a part of a forearm of a wearer. The term "vapor perspiration" herein refers to not only the state where perspiration in a gaseous condition remains present inside the glove to cause dampness inside the glove, but also the state where perspiration in a liquid condition remains present on a surface of a hand of the wearer to cause dampness inside the glove, both states of which result from the amount of perspiration of the wearer of the glove exceeding the amount of perspiration vaporized from inside the glove.

(Glove)

Figure 1A:
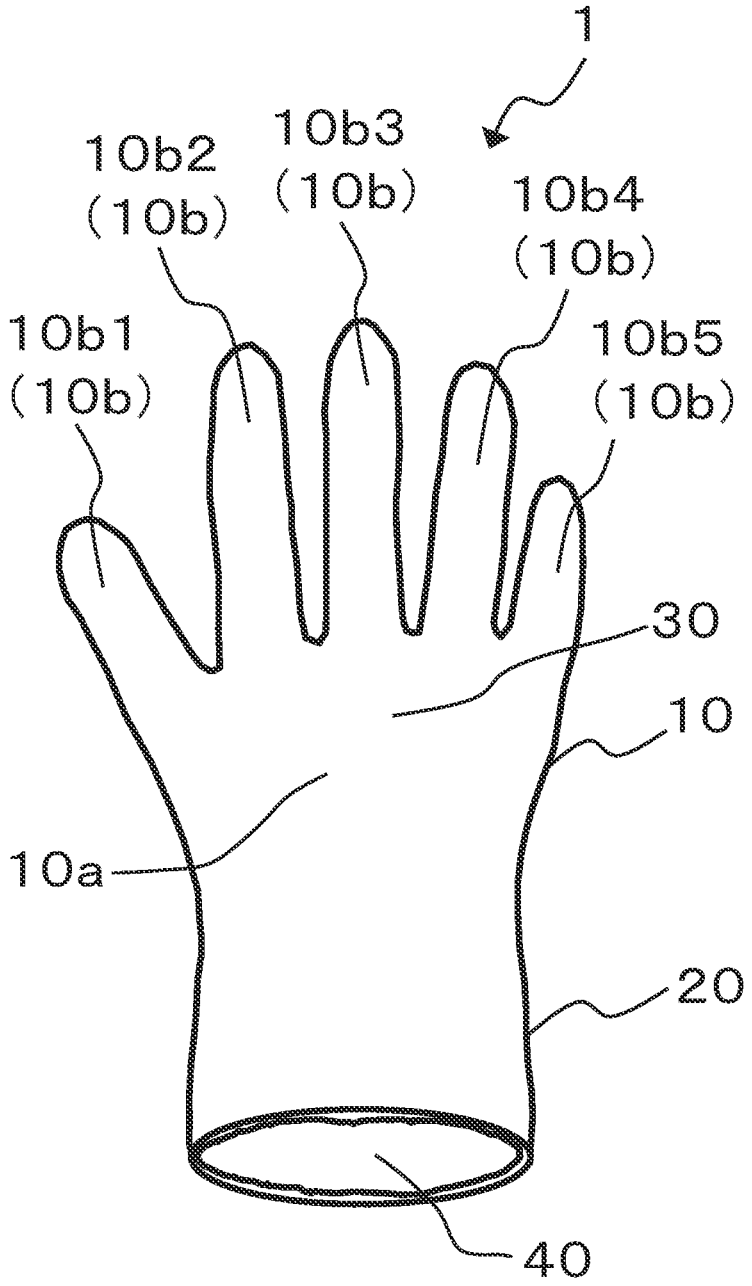
FIG. 1A is a view showing the overall configuration of a glove according to one embodiment of the present invention, as seen from its back side.
Figure 1B:
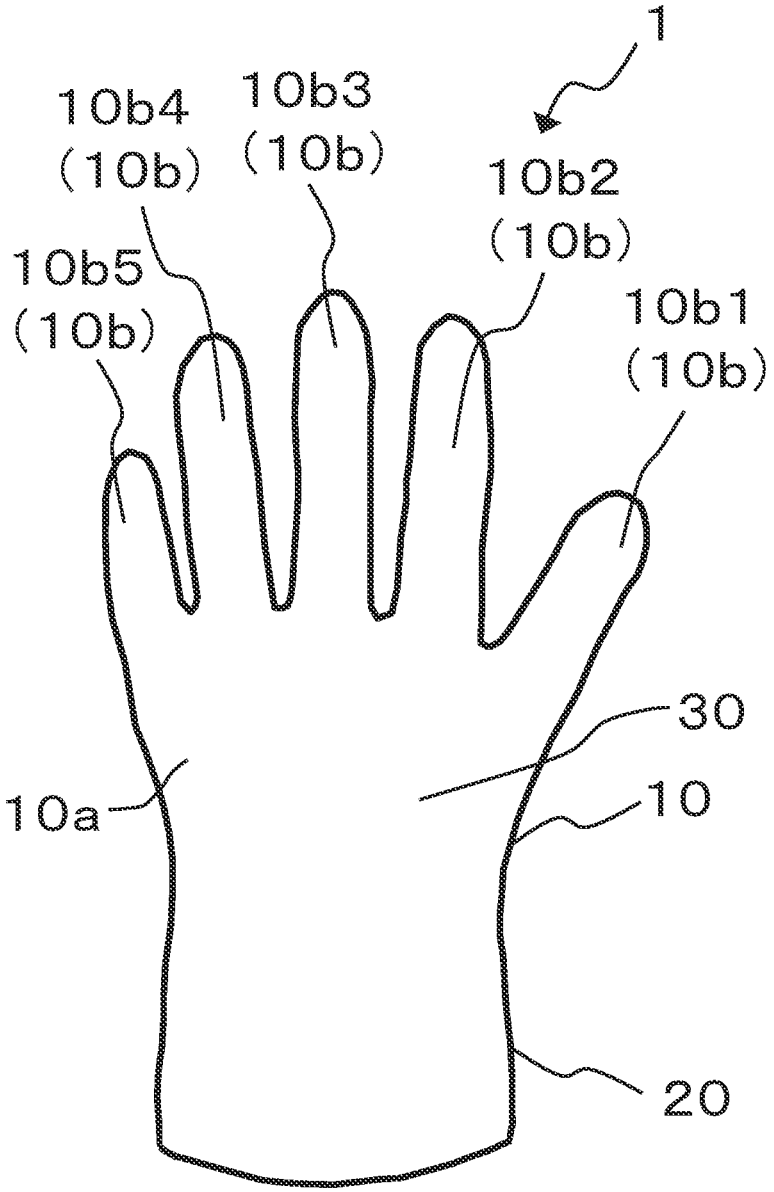
FIG. 1B is a view showing the overall configuration of the glove according to the one embodiment of the present invention, as seen from its palm side.

As shown in FIG. 1A and FIG. 1B, a glove 1 according to this embodiment includes a glove body 10 configured to cover a hand of a wearer, and a cuff 20 connected to the glove body 10 and configured to cover at least a wrist of the wearer. FIG. 1A and FIG. 1B show an example of the glove 1 with the glove body 10 and the cuff 20 formed integrally, but the glove body 10 and the cuff 20 of the glove 1 can be formed separately from each other.

In the glove 1 according to this embodiment, the glove body 10 includes a body bag 10*a* having a bag shape to cover the back and the palm of the hand of the wearer, and finger bags 10*b* each extending from the body bag 10*a* to cover each finger of the wearer. The finger bags 10*b* are formed of a first finger part 10*b*1, a second finger part 10*b*2, a third finger part 10*b*3, a fourth finger part 10*b*4, and a fifth finger part 10*b*5 to respectively cover a first finger (a thumb), a second finger (an index finger), a third finger (a middle finger), a fourth finger (a ring finger), and a fifth finger (a little finger), of the wearer. The first finger part 10*b*1 to the fifth finger part 10*b*5 have a tubular shape with their fingertip parts closed.

As shown in FIG. 2A, the glove body 10 in the glove 1 according to this embodiment has a two-layered structure. Specifically, in the glove 1 according to this embodiment, the glove body 10 includes a resin layer 30 forming an outer surface of the glove 1, and a vapor perspiration suppressing layer 40 laminated on one surface of the resin layer 30 to form an inner surface of the glove 1. That is, in the glove body 10 of the glove 1 according to this embodiment, the vapor perspiration suppressing layer 40 is an innermost layer (i.e., a layer that comes in contact with the hand of the wearer of the glove 1) forming the inner surface of the glove 1, and the resin layer 30 is an outermost layer forming the outer surface of the glove 1.

The resin layer 30 is mainly formed of a matrix resin. Used as the matrix resin are various known resins such as a vinyl chloride resin, a natural rubber, a nitrile butadiene rubber, a chloroprene rubber, a fluororubber, a silicone rubber, a isoprene rubber, polyurethane, an acrylic resin, or their modified products (e.g., a carboxyl-modified product). Alternatively, these various known resins are used in combination. The resin layer 30 functions as a waterproof layer configured to prevent water attached to the outer surface of the glove 1 from permeating into an inside of the glove 1.

The resin layer 30 can include a component other than the matrix resin. Examples of the component other than the matrix resin include: a vulcanizing agent such as sulfur; a vulcanization accelerator such as zinc dimethylthiocarbamate, zinc dibutylthiocarbamate, or zinc white; a crosslinking agent such as blocked isocyanate; a plasticizer or a softening agent such as a mineral oil or a phthalate ester; an antioxidant or an aging inhibitor such as 2,6-di-t-butyl-4-methyl phenol; a thickener such as an acrylic polymer or polysaccharide; a foaming agent such as azocarbonamide; a frothing agent or a foam stabilizer such as sodium stearate; an anti-tackiness agent such as a paraffin wax; an inorganic filler such as carbon black, calcium carbonate, or pulverizing silica; a metal oxide such as zinc oxide; a pH adjuster such as potassium hydroxide; and a pigment.

The resin layer 30 is preferably formed to have a thickness of 0.05 mm or more and 1.5 mm or less. The thickness of the resin layer 30 is measured by observing its cross section at a magnification of 200 times using a digital microscope (model VHX-6000, manufactured by KEYENCE CORPORATION), and then arithmetically averaging the values measured at 10 places at intervals of 500 μm. The cross-sectional observation using the digital microscope is carried out by observing a cross section of the center of a palm of the glove. The center of the palm of the glove herein means an area in the palm near the point at which a straight line drawn in a longitudinal direction of the glove (i.e., a direction in which the third finger part 10*b*3 extends) from the portion between the third finger part 10*b*3 and the fourth finger part 10*b*4 intersects with a straight line drawn in a lateral direction of the glove (i.e., a direction orthogonal to the longitudinal direction) from the portion between the first finger part 10*b*1 and the second finger part 10*b*2.

The resin layer 30 is preferably formed as a non-foamed layer to thereby have high strength. The term "non-foamed" herein means a state where the matrix resin is not foamed. The non-foamed state means the state where the expansion ratio is 1.0 time.

The vapor perspiration suppressing layer 40 includes a matrix resin and cellulose particles. In the vapor perspiration suppressing layer 40, the cellulose particles are preferably dispersed in the matrix resin. The vapor perspiration suppressing layer 40 is formed as a non-foamed layer.

Examples of the matrix resin included in the vapor perspiration suppressing layer 40 include the same resin as the matrix resin forming the resin layer 30.

Cellulose particles 40*a* included in the vapor perspiration suppressing layer 40 can be any known various cellulose particles, regenerated cellulose particles, or the like. The cellulose particles 40*a* are preferably particles of ground natural wood cellulose (hereinafter referred to as ground cellulose particles). As the cellulose particles 40*a*, KC FLOCK (registered trademark), for example, can be used. As KC FLOCK, KC FLOCK W-100GK (manufactured by Nippon Paper Industries Co., Ltd.), for example, can be used.

The vapor perspiration suppressing layer 40 includes 7 mass parts or more and 45 mass parts or less of the cellulose particles 40*a* based on 100 mass parts of the matrix resin. The vapor perspiration suppressing layer 40 preferably includes 7 mass parts or more and 35 mass parts or less of the cellulose particles 40*a* based on 100 mass parts of the matrix resin. The vapor perspiration suppressing layer 40 including 7 mass parts or more and 35 mass parts or less of the cellulose particles 40*a* based on 100 mass parts of the matrix resin can further suppress vapor perspiration from occurring inside the glove 1 even when a relatively large amount of perspiration is produced inside the glove 1. The vapor perspiration suppressing layer 40 preferably includes 8 mass parts or more and 25 mass parts or less of the cellulose particles 40*a* based on 100 mass parts of the matrix resin. The vapor perspiration suppressing layer 40 including 8 mass parts or more and 25 mass parts or less of the cellulose particles 40*a* based on 100 mass parts of the matrix resin can further suppress vapor perspiration from occurring inside the glove 1 even when a relatively large amount of perspiration is produced inside the glove 1. This configuration allows the glove 1 to be easily removed from the hand of the wearer even when a relatively large amount of perspiration is produced inside the glove 1. The vapor perspiration suppressing layer 40 more preferably includes 9 mass parts or more, further preferably includes 10 mass parts or more, of the cellulose particles 40*a* based on 100 mass parts of the matrix resin. Further, the vapor perspiration suppressing layer 40 more preferably includes 20 mass parts or less of the cellulose particles 40*a* based on 100 mass parts of the matrix resin.

The cellulose particles 40*a* included in the vapor perspiration suppressing layer 40 have an average particle size of 10 μm or more and 45 μm or less. The cellulose particles 40*a* preferably have an average particle size of 17 μm or more and 45 μm or less.

For the cellulose particles 40*a*, the average particle size is measured before the particles are mixed, using a laser diffraction-type particle-size-distribution measuring apparatus (Mastersizer 2000 manufactured by Malvern Panalytical Ltd) as a measuring device. Specifically, the measurement is performed using the dedicated software called Mastersizer 2000 Software in which the scattering type measurement mode is employed. A wet cell through which dispersion liquid with a measurement sample (cellulose particles) dispersed therein is circulated is irradiated with a laser beam to obtain a scattered light distribution from the measurement sample. Then, the scattered light distribution is approximated according to a log-normal distribution, and a particle size corresponding to the cumulative frequency of 50% (D50) within the preset range from the minimum value of 0.021 μm to the maximum value of 2000 μm in the obtained particle size distribution (horizontal axis, σ) is determined as the average particle size. The dispersion liquid for use is prepared by adding 60 mL of 0.5 mass % hexametaphosphoric acid aqueous solution to 350 mL of purified water. The concentration of the measurement sample in the dispersion liquid is 10%. Before the measurement, the dispersion liquid including the measurement sample is processed for two minutes using an ultrasonic homogenizer. The measurement is performed while the dispersion liquid including the measurement sample is agitated at an agitating speed of 1500 rpm.

The cellulose particles 40*a* are preferably fibrous particles. The fibrous particles are the particles having a ratio L/D being 2.0 or more, more preferably 2.5 or more, still more preferably 3.0 or more, where D represents the width of each particle and L represents the length of the particle. In the fibrous particles, the ratio L/D is preferably 50 or less, more preferably 30 or less, further preferably 20 or less, particularly preferably 10 or less. In the case where the cellulose particles 40*a* are fibrous particles, the length L is preferably 5 μm or more and 100 μm or less, more preferably 10 μm or more and 95 μm or less, while the width D is preferably 1 μm or more and 25 μm or less, more preferably 3 μm or more and 20 μm or less. The width of the particle means a length in the short side direction of each fibrous particle. In the case where the length in the short side direction varies depending on the measurement position, the largest value is regarded as the width of the particle. The length of the particle means a length in the longitudinal direction of each fibrous particle. In the case where the fibrous particle has a linear shape, the length of the particle means the length from an end of the linear shape to the other end thereof. In the case where the fibrous particle has a curled shape (for example, a crimped shape) or a bent shape (for example, an L-shape or a V-shape), the length of the particle means the length of the line segment connecting an end of the particle and the other end thereof in the curled or bent state. The width D of the particle and the length L of the particle can be obtained by measuring L and D of any 10 particles while observing the particles before being mixed at a magnification of 500 or 1000 times using a digital microscope (model VHX-6000, manufactured by KEYENCE CORPORATION), and then arithmetically averaging the measured values of L and D, respectively.

The cellulose particles 40*a* have a relatively high water absorption rate since cellulose includes a large number of hydroxyl groups. This configuration allows the cellulose particles 40*a* to relatively easily attract water. The relatively high water absorption rate herein means that the saturated water absorption rate is 7% or more in an environment at 25° C. temperature and at 65% relative humidity.

The vapor perspiration suppressing layer 40 can include an additive other than the cellulose particles 40*a*. Examples of the additive other than the cellulose particles 40*a* include a plasticizer, a pH adjuster, a vulcanizing agent, a metal oxide, a vulcanization accelerator, an aging inhibitor, an inorganic filler, a defoaming agent, a thickener, and a pigment.

Figure 2:
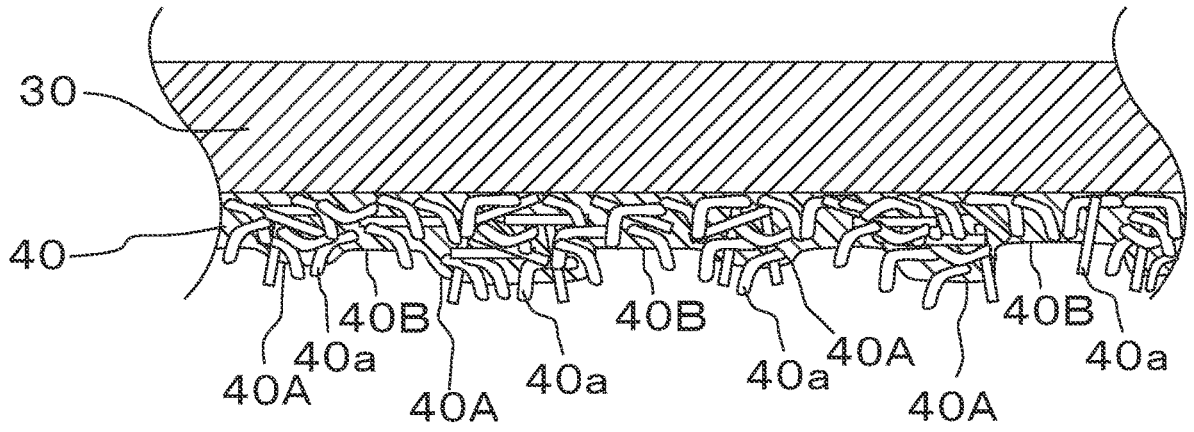
FIG. 2 is a cross-sectional view of the glove according to the one embodiment of the present invention.
Figure 3:
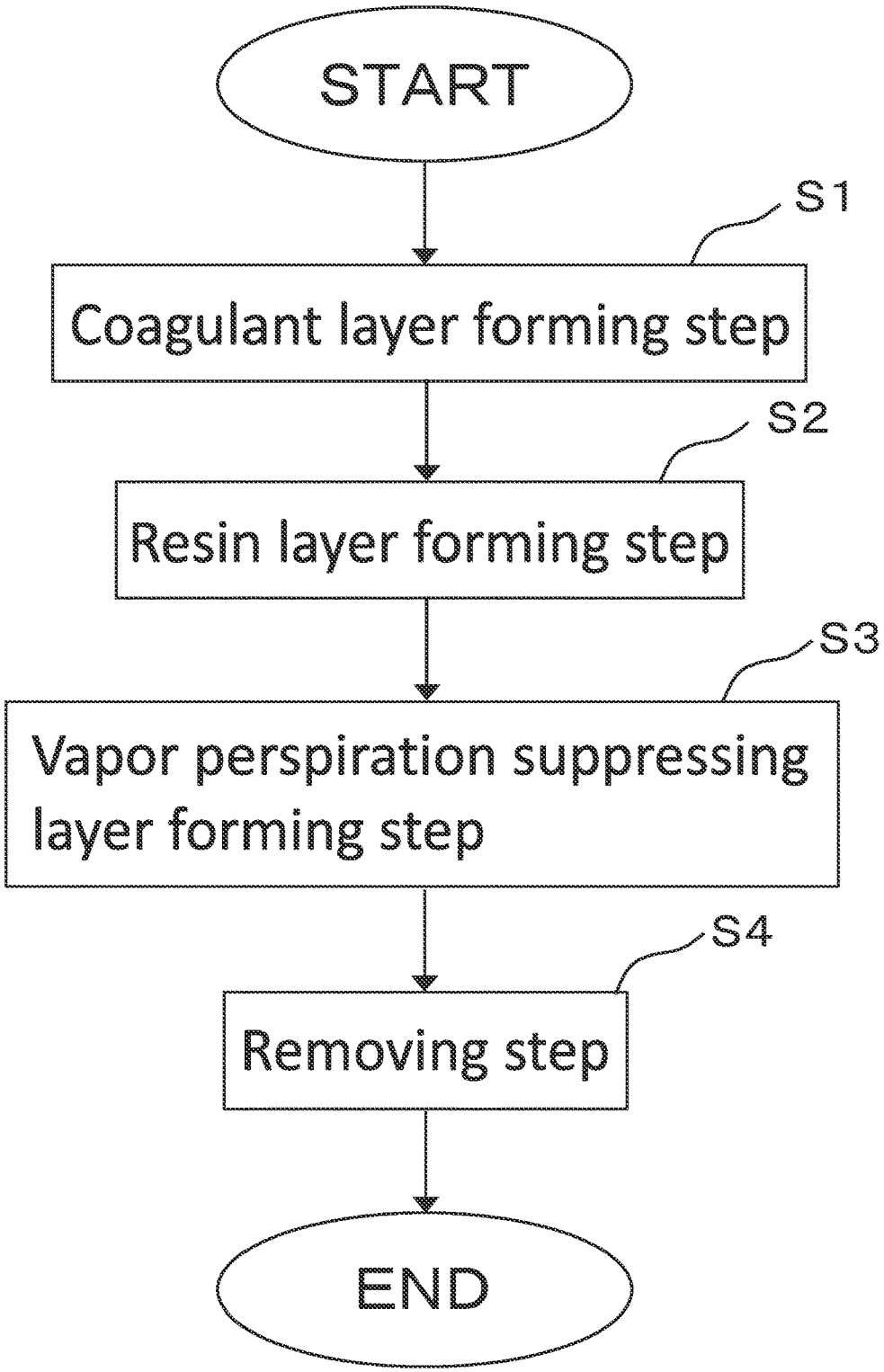
FIG. 3 is a flowchart showing a method for producing the glove according to the one embodiment of the present invention.

In the vapor perspiration suppressing layer 40, as shown in FIG. 2, at least some of the cellulose particles 40 are at least partially exposed from the matrix resin forming the inner surface of the glove 1.

As shown in FIG. 2, the vapor perspiration suppressing layer 40 includes, on the inner surface of the glove 1, projections 40A each formed by a plurality of cellulose particles 40*a* that gather in the vapor perspiration suppressing layer 40 and raise the inner surface, and recesses 40B that are recessed more to the resin layer 30 side than the projections 40A. That is, the vapor perspiration suppressing layer 40 (i.e., inner surface of the glove 1) has an uneven surface. The projections 40A and the recesses 40B in the vapor perspiration suppressing layer 40 are determined using a digital microscope (model VHX-6000, manufactured by KEYENCE CORPORATION). Specifically, the cross-sectional shape (measurement curve) of the vapor perspiration suppressing layer 40 is displayed on the monitor using the dedicated software under the conditions in which the line roughness mode is selected as the measurement mode, "roughness" is selected as the measurement type, the reference length is set to 1 mm, and no cutoff is made. In a portion of the measurement curve corresponding to the reference length, a portion projecting more toward the upper side of the monitor than the average line of the measurement curve is determined as a projection 40A while a portion recessed more toward the lower side of the monitor than the average line is determined as a recess 40B.

The vapor perspiration suppressing layer 40 is generally formed to have a thickness of 0.01 mm or more and 0.1 mm or less. The vapor perspiration suppressing layer 40 is preferably formed to have a thickness of 0.02 mm or more and 0.07 mm or less. The thickness of the vapor perspiration suppressing layer 40 is measured by observing its cross section at a magnification of 200 times using a digital microscope (model VHX-6000, manufactured by KEYENCE CORPORATION), and then arithmetically averaging the values measured at any 50 places.

In the glove body 10, the vapor perspiration suppressing layer 40 can be formed over the entire area of one surface of the resin layer 30 (i.e., inner surface of the glove in the state of being worn), or can be formed on a part of one surface of the resin layer 30 (i.e., inner surface of the glove in the state of being worn). The palm of the hand of the wearer of the glove 1 is easily recessed so as to be separated from the inner surface of the glove 1 while the back of the hand of the wearer of the glove 1 cannot be easily recessed so as to be separated from the inner surface of the glove 1. Thus, when the wearer of the glove 1 removes his or her hand from the inside of the glove 1, the back of the hand of the wearer tends to be stuck to the inner surface of the glove 1, and consequently the inner surface of the glove 1 tends to be caught on the back of the hand of the wearer. The damper the back of the hand of the wearer of the glove 1 is, the more remarkably the back of the hand of the wearer of the glove 1 is caught on the inner surface of the glove 1. Thus, the vapor perspiration suppressing layer 40 is preferably formed on at least a back part of the glove 1 in order to make the back of the hand of the wearer less damp. Although the palm of the wearer of the glove 1 is easily recessed to be separated from the inner surface of the glove 1 as aforementioned, the palm of the wearer of the glove 1 still tends to be caught on the inner surface of the glove 1 when the palm of the wearer of the glove 1 is damp. In order to suppress the palm of the wearer from being easily caught on the inner surface of the glove 1, therefore, the vapor perspiration suppressing layer 40 is preferably formed also on a palm part of the glove 1.

The cuff 20 is formed in a tubular shape. Similar to the glove body 10, the cuff 20 has a two-layered structure as shown in FIG. 2. Specifically, the cuff 20 includes the resin layer 30 forming the outer surface of the glove 1, and the vapor perspiration suppressing layer 40 laminated on one surface of the resin layer 30 to form the inner surface of the glove 1. That is, in the cuff 20, the vapor perspiration suppressing layer 40 is an innermost layer forming the inner surface of the glove 1 (i.e., the layer in contact with at least the wrist of the wearer of the glove 1) while the resin layer 30 is an outermost layer forming the outer surface of the glove 1. It should be noted that a description on the configurations will be omitted for the resin layer 30 of the cuff 20 and the vapor perspiration suppressing layer 40 of the cuff 20, which are formed in the same manner as the resin layer 30 of the glove body 10 and the vapor perspiration suppressing layer 40 of the glove body 10, respectively.

As described above, the cuff 20 is configured to cover at least the wrist of the wearer. The cuff 20 can be configured to cover a part of a forearm in addition to the wrist of the wearer. In the glove 1 according to this embodiment, the cuff 20 is preferably formed continuously and integrally with the glove body 10.

In the cuff 20, the vapor perspiration suppressing layer 40 can be formed over the entire area of one surface (i.e., inner surface in the state of being worn) of the resin layer 30, or can be formed on a part of one surface (i.e., inner surface in the state of being worn) of the resin layer 30. In the cuff 20, the wrist of the wearer of the glove 1 mainly tends to sweat. Thus, in the case where the vapor perspiration suppressing layer 40 is formed on a part of the one surface (i.e., inner surface in the state of being worn) of the resin layer 30, it is preferable that the vapor perspiration suppressing layer 40 be formed at least on the wrist portion of the cuff 20.

In the glove 1 according to this embodiment, a change rate Rc of a static contact angle calculated with an equation (1) below is preferably 20% or more and 90% or less, where $\theta_1$ represents a static contact angle immediately after a water droplet is brought into contact with the surface of the vapor perspiration suppressing layer 40 forming the innermost layer, and $\theta_2$ represents a static contact angle five seconds after a water droplet is brought into contact with the surface of the vapor perspiration suppressing layer 40 forming the innermost layer. The phrase "immediately after a water droplet is brought into contact with the surface of the vapor perspiration suppressing layer 40" means within a second after the water droplet is brought into contact with the surface of the vapor perspiration suppressing layer 40. The change rate Rc of the static contact angle calculated with the equation (1) below is more preferably 30% or more, further preferably 40% or more. Further, the change rate Rc of the static contact angle calculated with the equation (1) below is more preferably 85% or less. The configuration that the change rate Rc of the static contact angle calculated with the equation (1) falls within the above numerical range can further suppress vapor perspiration from occurring inside the glove 1 even when a relatively large amount of perspiration is produced inside the glove 1.

$$Rc = \frac{(\theta_1 - \theta_2)}{\theta_1} \times 100 \quad (1)$$

The static contact angle $\theta_1$ and the static contact angle $\theta_2$ can be obtained as follows:

(1) A part of the glove body 10 or a part of the cuff 20 is cut out to have a specific dimension from a given portion of the glove 1 to obtain a sample.

(2) The sample is allowed to dry in an oven at 100° C. for 30 minutes.

(3) For the sample that has been dried, a water droplet in a specific amount is brought into contact with a matrix resin surface of the vapor perspiration suppressing layer 40. Specifically, a water droplet in an amount of 25 μL is brought into contact with the matrix resin surface of the vapor perspiration suppressing layer 40 of the sample, using a micropipette.

(4) Within a second after the water droplet is brought into contact with the matrix resin surface of the vapor perspiration suppressing layer 40 of the sample, a static contact angle with the water droplet is measured. The static contact angle immediately after the water droplet is brought into contact with the matrix resin surface of the vapor perspiration suppressing layer 40 is measured using a contact angle measuring device "DropMaster500" (manufactured by Kyowa Interface Science Co., Ltd.), and evaluation and analysis software "FAMAS" (manufactured by Kyowa Interface Science Co., Ltd.). The static contact angle immediately after the water droplet is brought into contact with the matrix resin surface of the vapor perspiration suppressing layer 40 is calculated by the θ/2 method.

(5) The static contact angle is measured five seconds after the water droplet is brought into contact with the matrix resin surface of the vapor perspiration suppressing layer 40 of the sample. The static contact angle five seconds after the water droplet is brought into contact with the matrix resin surface of the vapor perspiration suppressing layer 40 is measured in the same manner as in the measurement of the static contact angle immediately after the water droplet is brought into contact with the vapor perspiration suppressing layer 40.

(6) The steps (1) to (5) are performed for samples cut out from three given portions of the glove body 10 (i.e., three samples) to obtain the static contact angle values immediately after the water droplet is brought into contact with the matrix resin surface of the vapor perspiration suppressing layer 40 and the static contact angle values five seconds after the water droplet is brought into contact with the matrix resin of the vapor perspiration suppressing layer 40 for the respective three samples, followed by arithmetically averaging these values respectively to obtain the value of the static contact angle $9\theta_1$ and the value of the static contact angle $\theta_2$.

It is not clear why the glove 1 according to this embodiment can relatively suppress vapor perspiration from occurring thereinside even when a relatively large amount of perspiration is produced inside the glove 1, but the present inventors infer the reason as follows.

In the glove 1 according to this embodiment, the vapor perspiration suppressing layer 40 has at least some of the cellulose particles 40*a* exposed from the matrix resin surface (i.e., inner surface of the glove 1). Specifically, in the glove 1 according to this embodiment, the average particle size of the cellulose particles 40*a* and the content of the cellulose particles 40*a* are adjusted to allow the vapor perspiration suppressing layer 40 to have at least some of the cellulose particles 40*a* moderately exposed from the matrix resin surface (i.e., inner surface of the glove 1). As described above, the cellulose particles 40*a* relatively easily absorb water since cellulose includes a large number of hydroxyl groups as above. Thus, it is considered that the matrix resin surface of the vapor perspiration suppressing layer 40 (i.e., inner surface of the glove 1) has reasonable hydrophilicity with at least some of the cellulose particles 40*a* moderately exposed therefrom. When the wearer produces a relatively large amount of perspiration in the glove 1 according to this embodiment and the perspiration is attached to the matrix resin surface of the vapor perspiration suppressing layer 40 (i.e., inner surface of the glove 1), it is considered that the perspiration spreads thinly on the matrix resin surface of the vapor perspiration suppressing layer 40 (i.e., inner surface of the glove 1) while being attracted to those cellulose particles 40*a* exposed from the surface. Since the vapor perspiration suppressing layer 40 includes a specific amount (7 mass parts or more and 45 mass parts or less based on 100 mass parts of the matrix resin) of the cellulose particles 40*a* having a specific average particle size (10 μm or more and 45 μm or less), a moderately uneven surface (i.e., projections 40A and recesses 40B) is formed on the matrix resin surface of the vapor perspiration suppressing layer 40 (i.e., inner surface of the glove 1). Thus, the glove 1 according to this embodiment allows the vapor perspiration suppressing layer 40 having the moderately uneven surface to have a larger surface area than that of a glove having at least some of the cellulose particles exposed from a relatively flat surface. In the glove 1 according to this embodiment, the large surface area of the vapor perspiration suppressing layer 40 allows a relatively large amount of the cellulose particles 40*a* to be exposed from the matrix resin surface of the vapor perspiration suppressing layer 40 (i.e., inner surface of the glove 1); thus, perspiration spreading is considered to be accelerated on the matrix resin surface of the vapor perspiration suppressing layer 40 (i.e., inner surface of the glove 1).

Further, the glove 1 according to this embodiment in which the vapor perspiration suppressing layer 40 is formed as a non-foamed layer is considered to have a relatively smaller number of recesses formed to be recessed to an inner side of the matrix resin surface of the vapor perspiration suppressing layer 40 (i.e., inner surface of the glove 1), that is, recessed to the resin layer 30 side, than in the glove in which the vapor perspiration suppressing layer 40 is formed as a foamed layer. This configuration is considered to be capable of relatively suppressing perspiration spreading on the matrix resin surface of the vapor perspiration suppressing layer 40 (i.e., inner surface of the glove 1) from intruding inside the vapor perspiration suppressing layer 40 and remaining therein.

In the glove 1 according to this embodiment, the cellulose particles 40*a* included in the vapor perspiration suppressing layer 40 have an average particle size of 10 μm or more and 45 μm or less, which is significantly shorter than short fibers such as piles having a fiber length of 300 μm or more and 800 μm or less; thus, portions of the cellulose particles 40*a* exposed from the matrix resin surface of the vapor perspiration suppressing layer 40 (i.e., inner surface of the glove 1) are also considered to be relatively shorter than portions of such short fibers that would be exposed therefrom. Thus, even in the case where perspiration is absorbed by the exposed portions of the cellulose particles 40*a*, the exposed portions of the cellulose particles 40*a* being relatively short are considered to be capable of being dried relatively quickly.

Even in the case where the wearer produces a relatively large amount of perspiration, the above configuration allows the perspiration attached to the matrix resin surface of the vapor perspiration suppressing layer 40 (i.e., inner surface of the glove 1) to spread relatively quickly while forming a thin water film on the matrix resin surface of the vapor perspiration suppressing layer 40 (i.e., inner surface of the glove 1), with the perspiration being suppressed from intruding inside the vapor perspiration suppressing layer 40 and remaining thereinside. Thus, the matrix resin surface of the vapor perspiration suppressing layer 40 (i.e., inner surface of the glove 1) is considered to be dried relatively quickly. Since the portions of the cellulose particles 40*a* exposed from the matrix resin surface of the vapor perspiration suppressing layer 40 (i.e., inner surface of the glove 1) are relatively short, the exposed portions are considered to be capable of being dried relatively quickly even when they absorb perspiration. This configuration is considered by the present inventors to enable the glove 1 according to this embodiment to relatively suppress vapor perspiration from occurring thereinside even when a relatively large amount of perspiration is produced in the glove 1.

The aforementioned mechanism allows perspiration attached to the skin surface of the wearer to easily migrate to the matrix resin surface of the vapor perspiration suppressing layer 40 (i.e., inner surface of the glove 1), and thus allows the perspiration to be easily separated from the skin surface of the wearer, consequently relieving the wearer's discomfort. When short fibers such as piles having a fiber length as long as 300 μm or more and 800 μm or less are included in the vapor perspiration suppressing layer 40, it becomes difficult to dry perspiration retained by capillary action of the short fibers and to disperse the perspiration in the matrix resin surface of the vapor perspiration suppressing layer 40 (i.e., inner surface of the glove 1), thereby causing vapor perspiration to easily occur inside the glove 1. However, the glove 1 according to this embodiment in which the vapor perspiration suppressing layer 40 includes the cellulose particles 40*a* significantly shorter than short fibers such as piles can suppress retained perspiration from being hardly dried, and can suppress perspiration from being hardly dispersed in the matrix resin surface of the vapor perspiration suppressing layer 40 (i.e., inner surface of the glove 1). Further, when the vapor perspiration suppressing layer 40 is formed as a foamed layer, perspiration tends to be easily accumulated in voids formed on, for example, the surface of the foamed layer by foaming to sometimes make it difficult to dry the perspiration inside the glove. There are some cases where perspiration accumulated in the voids formed on, for example, the surface of the foamed layer is extruded onto the matrix resin surface of the vapor perspiration suppressing layer 40 to increase the wearer's discomfort when the wearer grasps an object. However, the glove 1 according to this embodiment in which the vapor perspiration suppressing layer 40 is formed as a non-foamed layer can suppress perspiration from being easily accumulated inside the vapor perspiration suppressing layer 40. This configuration can suppress perspiration from being hardly dried inside the glove 1, and can suppress perspiration from being extruded onto the matrix resin surface of the vapor perspiration suppressing layer 40 to increase the wearer's discomfort. The short fibers generally have an L/D value of 50 or more, where D represents the width of the short fibers and L represents the length thereof.

(Method for Producing Glove)

The glove 1 according to this embodiment is produced by a production method including: a coagulant layer forming step S1 of forming a coagulant layer including a coagulant on a surface of a hand former; a resin layer forming step S2 of forming the resin layer 30 to cover the coagulant layer; a vapor perspiration suppressing layer forming step S3 of forming the vapor perspiration suppressing layer 40 to cover the resin layer 30; and a removing step S4 of removing a layered product of the resin layer 30 and the vapor perspiration suppressing layer 40 covering the hand former from the hand former while turning the layered product inside out. In this embodiment, a description is given on an example of producing the glove 1 by performing the coagulant layer forming step S1, which is not an essential step. That is, the coagulant layer forming step S1 can be omitted from the method for producing the glove 1.

<Coagulant Layer Forming Step S1>

In the coagulant layer forming step S1, a hand former is immersed in a coagulant solution to thereby form a coagulant layer on an outer surface of the hand former. Specifically, in the coagulant layer forming step S1, the hand former is immersed in the coagulant solution and pulled out thereof, and thereafter a solvent in the coagulant solution is vaporized to thereby form the coagulant layer on the outer surface of the hand former. As the coagulant solution, various known coagulant solutions can be used. As the coagulant solution, for example, methanol solutions or aqueous solutions including a multivalent metal salt or an organic acid can be used.

Examples of the multivalent metal salt include barium chloride, calcium chloride, magnesium chloride, zinc chloride, aluminum chloride, barium nitrate, calcium nitrate, zinc nitrate, barium acetate, calcium acetate, zinc acetate, calcium sulfate, magnesium sulfate, and aluminum sulfate. These can be used individually, or two or more of these can be used in combination.

The lower limit content of the multivalent metal salt in the coagulant solution is preferably 8 mass %, more preferably 15 mass %, further preferably 40 mass %. The content of the multivalent metal salt being 8 mass % or more in the coagulant solution enables the coagulant solution to exhibit sufficient solidification force. When the hand former with the coagulant layer formed thereon is immersed in a resin composition in the resin layer forming step S2 as will be described later, the above configuration can suppress the resin composition attached to the coagulant layer from having an insufficient thickness, and can suppress the resin layer 30 from having an uneven thickness, which is caused by the resin composition dripped from the coagulant layer. The upper limit content of the multivalent metal salt in the coagulant solution is preferably 95 mass %, more preferably 90 mass %. When the hand former with the coagulant layer formed thereon is immersed in the resin composition in the resin layer forming step S2 as will be described later, the content of the multivalent metal salt being 95 mass % or less in the coagulant solution can suppress excessive aggregation from occurring in the resin composition attached to the surface of the coagulant layer. This configuration can suppress the resin layer 30 from having an uneven thickness.

Examples of the organic acid include acetic acid and citric acid. The content of the organic acid in the coagulant solution is preferably 5 mass % or more and 35 mass % or less. The organic acid can be used individually, or can be used in combination with the multivalent metal salt. Use of the organic acid in combination with the multivalent metal salt enables the glove body 10 and the cuff 20 to have a sufficient thickness, and enables a capability of forming the resin layer 30 using the resin composition to be relatively easily controlled.

The temperature of the hand former when immersed in the coagulant solution is preferably 40° C. or more and 80° C. or less. The temperature of the hand former set to 40° C. or more and 80° C. or less enables the coagulant solution to be attached to the outer surface of the hand former so as to have a relatively uniform thickness. Thus, the coagulant layer can have a relatively uniform thickness. The duration of time for which the hand former is immersed in the coagulant solution is not particularly limited, but is generally between five seconds to a minute.

The temperature at which the solvent in the coagulant solution is vaporized after the hand former is pulled out of the coagulant solution is preferably 25° C. or more and 80° C. or less. The duration of time for which the solvent in the coagulant solution is vaporized after the hand former is pulled out of the coagulant solution is preferably 10 seconds or more and 600 seconds or less. The temperature and duration of time for which the solvent in the coagulant solution is vaporized are set to fall within the above numerical ranges to enable the coagulant layer having a relatively uniform thickness to be formed on the outer surface of the hand former.

<Resin Layer Forming Step S2>

In the resin layer forming step S2, the hand former with the coagulant layer formed thereon is immersed in a first coating liquid including a matrix resin to thereby form the resin layer 30 so as to cover the coagulant layer. Specifically, in the resin layer forming step S2, the hand former with the coagulant layer formed thereon is immersed in the first coating liquid and pulled out thereof, followed by being allowed to dry at a specific temperature for a specific duration of time to thereby form the resin layer 30 so as to cover the coagulant layer. In the resin layer forming step S2, it is preferable that the hand former with the coagulant layer formed thereon be immersed in the first coating liquid so as to have the entire area of the outer surface of the coagulant layer covered with the first coating liquid.

Used as the matrix resin included in the first coating liquid are various known resins such as a vinyl chloride resin, a natural rubber, a nitrile butadiene rubber, a chloroprene rubber, a fluororubber, a silicone rubber, an isoprene rubber, polyurethane, an acrylic resin, or their modified products (e.g., a carboxyl-modified product). Alternatively, these various known resins are used in combination. A suitable resin can be used from among these various known resins depending on purpose. For example, when the resin layer 30 is intended to have an increased strength and ease of processing, it is preferable to use a latex such as a natural rubber and a nitrile-butadiene rubber. In this case, the resin composition is prepared to have a ratio of solid contents of 20 to 60 mass %. The ratio of solid contents is adjusted using water or the like.

The first coating liquid can include any component other than the matrix resin. Examples of the component other than the matrix resin include: a vulcanizing agent such as sulfur; a vulcanization accelerator such as zinc dimethylthiocarbamate, zinc dibutylthiocarbamate, or zinc white; a cross-linking agent such as blocked isocyanate; a plasticizer or a softening agent such as a mineral oil or a phthalate ester; an antioxidant or an aging inhibitor such as 2,6-di-t-butyl-4-methyl phenol; a thickener such as an acrylic polymer or polysaccharide; a foaming agent such as azocarbonamide; a frothing agent or a foam stabilizer such as sodium stearate; an anti-tackiness agent such as a paraffin wax; an inorganic filler such as carbon black, calcium carbonate, or pulverizing silica; a metal oxide such as zinc oxide; a pH adjuster such as potassium hydroxide; and a pigment. Among these, the resin composition preferably includes the pH adjuster, the vulcanizing agent, the metal oxide, the vulcanization accelerator, and the aging inhibitor.

The pH adjuster is preferably included in an amount of 0.2 mass part or more and 0.7 mass part or less based on 100 mass parts of the matrix resin. The vulcanizing agent is preferably included in an amount of 0.1 mass part or more and 2.0 mass parts or less based on 100 mass parts of the matrix resin. The metal oxide is preferably included in an amount of 1.0 mass part or more and 4.0 mass parts or less based on 100 mass parts of the matrix resin. The vulcanization accelerator is preferably included in an amount of 0.1 mass part or more and 2.0 mass parts or less based on 100 mass parts of the matrix resin. The aging inhibitor is preferably included in an amount of 0.3 mass part or more and 0.7 mass part or less based on 100 mass parts of the matrix resin.

The inorganic filler, the defoaming agent, the thickener, and the pigment each can be added to the first coating liquid in an appropriate amount as needed. Various known inorganic fillers, defoaming agents, thickeners, and pigments can be used.

Viscosity of the first coating liquid is preferably 200 to 3000 mPa·s when measured under a condition of V6 by using a B-type viscometer.

The temperature of the hand former when immersed in the first coating liquid is preferably 25° C. or more and 60° C. or less. The duration of time for which the hand former is immersed in the first coating liquid is not particularly limited, but can be, for example, set to 10 seconds or more and 200 seconds or less.

After the hand former is pulled out of the first coating liquid, the hand former with the first coating liquid applied thereto is placed in, for example, an oven for drying at a specific temperature for a specific duration of time to thereby form the resin layer 30 so as to cover the coagulant layer. The hand former with the first coating liquid applied thereto can be, for example, dried at 80° C. for 60 minutes.

<Vapor Perspiration Suppressing Layer Forming Step S3>

In the vapor perspiration suppressing layer forming step S3, the hand former with the resin layer 30 formed thereon is immersed in a second coating liquid including a matrix resin and the cellulose particles 40*a* to thereby form the vapor perspiration suppressing layer 40 so as to cover the resin layer 30. Specifically, in the vapor perspiration suppressing layer forming step S3, the hand former with the resin layer 30 formed thereon is immersed in the second coating liquid and pulled out thereof, followed by being allowed to dry at a specific temperature for a specific duration of time to thereby form the vapor perspiration suppressing layer 40 so as to cover the resin layer 30. In the vapor perspiration suppressing layer forming step S3, it is preferable that the hand former with the resin layer 30 formed thereon be immersed in the second coating liquid so as to cover the entire area of the surface of the resin layer 30.

As the matrix resin included in the second coating liquid, used can be the same resin as the matrix resin included in the first coating liquid.

As the cellulose particles 40*a* included in the second coating liquid, used can be the aforementioned various known cellulose particles. The cellulose particles 40*a* included in the second coating liquid have an average particles size of 10 μm or more and 45 μm or less. The second coating liquid includes 7 mass parts or more and 45 mass parts or less of the cellulose particles 40*a* based on 100 mass parts of the matrix resin. The second coating liquid is not subjected to any foaming treatment such as physical foaming or chemical foaming. That is, the second coating liquid is a non-foamed solution.

Similar to the first coating liquid, the second coating liquid can include, for example, a pH adjuster, a vulcanizing agent, a metal oxide, a vulcanization accelerator, an aging inhibitor, an inorganic filler, a defoaming agent, a thickener, and a pigment, in addition to the matrix resin.

Viscosity of the second coating liquid is preferably 200 to 2000 mPa·s when measured under a condition of V6 by using a B-type viscometer.

The temperature of the hand former when immersed in the second coating liquid is preferably 25° C. or more and 60° C. or less. The duration of time for which the hand former is immersed in the second coating liquid is not particularly limited, but can be, for example, set to 10 seconds or more and 200 seconds or less.

After the hand former is pulled out of the second coating liquid, the hand former with the second coating liquid applied thereto is placed in, for example, an oven for drying at a specific temperature for a specific duration of time to thereby form the vapor perspiration suppressing layer 40 so as to cover the resin layer 30. The hand former with the second coating liquid applied thereto can be, for example, allowed to dry with the following two steps:

(1) First, dry the hand former at 80° C. for 60 minutes.

(2) Next, dry the hand former at 120° C. for 30 minutes.

Drying the hand former at 120° C. for 30 minutes allows the resin layer 30 and the vapor perspiration suppressing layer 40 to more sufficiently dry, and enables a crosslinking (vulcanizing) reaction to sufficiently proceed to impart necessary strength to the glove 1.

<Removing Step S4>

In the removing step S4, a layered product of the resin layer 30 and the vapor perspiration suppressing layer 40 covering the hand former is removed from the hand former while being turned inside out. That is, the layered product of the resin layer 30 and the vapor perspiration suppressing layer 40 is removed from the hand former so that the vapor perspiration suppressing layer 40 serving as the outermost layer of the glove 1 in the state of covering the hand former turns to the innermost layer of the glove 1 and the resin layer 30 serving as the innermost layer of the glove 1 in the state of covering the hand former turns to the outermost layer of the glove 1.

As described above, the coagulant layer forming step S1, the resin layer forming step S2, the vapor perspiration suppressing layer forming step S3, and the removing step S4 are sequentially performed in this order to be capable of obtaining the glove 1 with the resin layer 30 forming the outermost layer and the vapor perspiration suppressing layer 40 forming the innermost layer.

The matters disclosed herein include the following:

(1)

A glove including a glove body configured to cover a hand of a wearer, in which

- the glove body includes an innermost layer forming an inner surface of the glove,
- the innermost layer includes a matrix resin and cellulose particles,
- at least some of the cellulose particles are at least partially exposed from the inner surface,
- the innermost layer includes 7 mass parts or more and 45 mass parts or less of the cellulose particles based on 100 mass parts of the matrix resin, and is formed as a non-foamed layer, and
- the cellulose particles have an average particle size of 10 μm or more and 45 μm or less.

Such a configuration can relatively suppress vapor perspiration from occurring inside the glove even in the case where a relatively large amount of perspiration is produced inside the glove.

(2)

The glove according to (1) above, in which the innermost layer includes 8 mass parts or more and 25 mass parts or less of the cellulose particles based on 100 mass parts of the matrix resin.

Such a configuration can further suppress vapor perspiration from occurring inside the glove even in the case where a relatively large amount of perspiration is produced inside the glove. The configuration also enables the glove to be easily removed from the hand of the wearer even in the case where a relatively large amount of perspiration is produced inside the glove.

(3)

The glove according to (1) or (2) above, in which a change rate Rc of a static contact angle calculated with an equation (1) below is 20% or more and 90% or less:

$$Rc = \frac{(\theta_1 - \theta_2)}{\theta_1} \times 100 \quad (1)$$

where $\theta_1$ represents a static contact angle immediately after a water droplet is brought into contact with a surface of the innermost layer, and $\theta_2$ represents a static contact angle five seconds after the water droplet is brought into contact with the surface of the innermost layer.

Such a configuration can further suppress vapor perspiration from occurring inside the glove even in the case where a relatively large amount of perspiration is produced inside the glove.

The glove according to the present invention is not limited to the configuration of the aforementioned embodiment. The glove according to the present invention is not limited by the aforementioned operation effects, either. Various modifications can be made to the glove according to the present invention without departing from the gist of the present invention.

The aforementioned embodiment has been described by taking, for example, the case where the glove 1 includes the glove body 10 configured to cover the hand of the wearer, and the cuff 20 connected to the glove body 10 and configured to cover at least the wrist of the wearer. However, the configuration of the glove 1 is not limited to this configuration. The configuration can be such that the glove 1 includes only the glove body 10 configured to cover the hand of the wearer.

The aforementioned embodiment has been described by taking, for example, the case where the outer surface of the glove body 10 is not subjected to any treatment. However, the configuration of the glove 1 is not limited to this configuration. The configuration of the glove 1 can be such that the outer surface of the glove body 10 has an anti-slipping pattern. For applying the anti-slipping pattern on the outer surface of the glove body 10, it is preferable that the anti-slipping pattern be applied to a palm portion of the body bag 10*a*, a fingertip portion of the first finger part 10*b*1, a fingertip portion of the second finger part 10*b*2, a fingertip portion of the third finger part 10*b*3, a fingertip part of the fourth finger part 10*b*4, and a fingertip part of the fifth finger part 10*b*5, of the glove body 10.

Further, the configuration can be such that the glove 1 includes a reinforcing layer for increased strength. Specifically, the configuration can be such that the glove 1 includes the reinforcing layer on a fingertip portion of the first finger part 10*b*1, a fingertip portion of the second finger part 10*b*2, a fingertip portion of the third finger part 10*b*3, a fingertip part of the fourth finger part 10*b*4, and a fingertip part of the fifth finger part 10*b*5, of the glove body 10. The reinforcing layer can be formed by immersing the fingertip portion of the first finger part 10*b*1, the fingertip portion of the second finger part 10*b*2, the fingertip portion of the third finger part 10*b*3, the fingertip part of the fourth finger part 10*b*4, and the fingertip part of the fifth finger part 10*b*5, of the glove body 10 in a coating liquid including a matrix resin, followed by allowing these portions to dry. As the coating liquid including the matrix resin, used can be the same liquid as the first coating liquid.

EXAMPLES

Hereinafter, the present invention will be more specifically described by way of examples. The following examples are provided for more specifically describing the present invention, and do not intend to limit the scope of the present invention.

Example 1

The glove according to Example 1 was produced using the following materials.

(First Resin Layer)

First, a three-dimensional ceramic hand former was heated to 50° C. Next, a portion of the heated three-dimensional hand former corresponding to a glove body (hereinafter referred to as glove body corresponding portion) and a portion thereof corresponding to the cuff (hereinafter referred to as cuff corresponding portion) were immersed in a coagulant solution in which 60 mass parts of calcium nitrate was dissolved in 100 mass parts of water to apply the coagulant solution to the outer surfaces of the glove body corresponding portion and the cuff corresponding portion of the three-dimensional hand former. The three-dimensional hand former to which the coagulant solution had been applied was allowed to dry at 30° C. for three minutes. Then, the glove body corresponding portion and the cuff corresponding portion of the three-dimensional hand former to which the coagulant solution had been applied were immersed in a first coating liquid for forming the resin layer to apply the first coating liquid to the outer surfaces of the glove body corresponding portion and the cuff corresponding portion of the three-dimensional hand former. Next, the three-dimensional hand former to which the first coating liquid had been applied was allowed to dry at 80° C. for 60 minutes to form a resin layer on the glove body corresponding portion and the cuff corresponding portion of the three-dimensional hand former.

The first coating liquid was prepared by diluting the composition including the mixing materials shown in Table 1 with ion exchange water to have a solid content at a ratio of 42 mass %. The first coating liquid had a viscosity of 1000 m Pa·s (the value measured using a Brookfield viscometer under the condition of V6 (i.e., a rotational speed of 6 rpm, a temperature of 25° C.)). The first coating liquid was not subjected to any foaming treatment such as physical foaming or chemical foaming. That is, the first coating liquid was a non-foamed solution.

TABLE 1

| Mixing material | Mixing ratio [mass parts of solid content] |
|---|---|
| NBR latex (Lx-550, manufactured by Zeon Corporation) | 100.0 |
| 5% KOH | 0.2 |
| Colloidal sulfur | 0.5 |
| Zinc oxide | 2.0 |
| Vulcanization accelerator (NOCCELER BZ, manufactured by OUCHI SHINKO CHEMICAL INDUSTRIAL CO., LTD.) | 0.2 |
| Aging inhibitor (VULKANOX (registered trademark) BKF) | 0.5 |

TABLE 1-continued

| Mixing material | Mixing ratio [mass parts of solid content] |
|---|---|
| Ammonia | 0.2 |
| Inorganic filler, defoaming agent, thickener, pigment | 5.0 |

*The mixing ratios are calculated assuming that the mixing materials are solid contents.

(Vapor Perspiration Suppressing Layer)

After the resin layer had been formed, the three-dimensional hand former was cooled to 60° C. Next, the glove body corresponding portion and the cuff corresponding portion of the three-dimensional hand former to which the resin layer had been formed were immersed in a second coating liquid for forming the vapor perspiration suppressing layer to apply the second coating liquid to the entire area of the outer surface of the resin layer. Then, the three-dimensional hand former to which the second coating liquid had been applied was allowed to dry with the following two steps to form the vapor perspiration suppressing layer on the entire area of the outer surface of the resin layer:

(1) First, dry the hand former at 80° C. for 60 minutes.

(2) Next, dry the hand former at 120° C. for 30 minutes.

Next, a layered product of the resin layer and the vapor perspiration suppressing layer covering the three-dimensional hand former was removed from the three-dimensional hand former while being turned inside out. That is, the layered product of the resin layer and the vapor perspiration suppressing layer was removed from the three-dimensional hand former so that the vapor perspiration suppressing layer serving as the outermost layer of the glove in the state of covering the three-dimensional hand former turned to the innermost layer of the glove and the resin layer serving as the innermost layer of the glove in that state turned to the outermost layer of the glove. The glove according to Example 1 was thus obtained.

The second coating liquid was prepared by diluting the composition including the mixing materials shown in Table 2 with ion exchange water to have a solid content at a ratio of 15 mass %. The second coating liquid had a viscosity of 500 m Pa·s (the value measured using a Brookfield viscometer under the condition of V6 (i.e., a rotational speed of 6 rpm, a temperature of 25° C.)). As shown in Table 2 below, the cellulose particle were added in an amount of 7.5 mass parts based on 100 mass parts of the resin (NBR latex). The second coating liquid was not subjected to any foaming treatment such as physical foaming or chemical foaming. That is, the second coating liquid was a non-foamed solution. Further, an observation of the cross section of the vapor perspiration suppressing layer at a magnification of 300 times using a digital microscope (model VHX-6000, manufactured by KEYENCE CORPORATION) found that some of the cellulose particles were partially exposed from the outer surface of the vapor perspiration suppressing layer.

TABLE 2

| Mixing material | Mixing ratio [mass parts of solid content] |
|---|---|
| NBR latex (Lx-550, manufactured by Zeon Corporation) | 100.0 |
| 5% KOH | 0.1 |
| Colloidal sulfur | 0.5 |

TABLE 2-continued

| Mixing material | Mixing ratio [mass parts of solid content] |
|---|---|
| Zinc oxide | 2.0 |
| Vulcanization accelerator (NOCCELER BZ, manufactured by OUCHI SHINKO CHEMICAL INDUSTRIAL CO., LTD.) | 0.2 |
| Aging inhibitor (VULKANOX (registered trademark) BKF) | 0.5 |
| Ammonia | 0.2 |
| Inorganic filler, defoaming agent, thickener, pigment | 5.0 |
| Cellulose particles (KC FLOCK (registered trademark) W-100GK) | 7.5 |

*The mixing ratios are calculated assuming that the mixing materials are solid contents.

The average particle size of the cellulose particles included in the vapor perspiration suppressing layer was 37 μm, according to the measurement thereof before mixing, using a laser diffraction-type particle-size-distribution measuring apparatus (Mastersizer 2000 manufactured by Malvern Panalytical Ltd). The average particle size of the cellulose particles was measured as follows. That is, the dedicated software called Mastersizer 2000 Software was used, the scattering type measurement mode was employed, and a wet cell through which dispersion liquid with the cellulose particles dispersed therein is circulated was irradiated with a laser beam, to obtain a scattered light distribution from the cellulose particles. Then, the scattered light distribution was approximated according to a log-normal distribution, and a particle size corresponding to the cumulative frequency of 50% (D50) within the preset range from the minimum value of 0.021 μm to the maximum value of 2000 μm in the obtained particle size distribution (horizontal axis, σ) was determined as the average particle size. In the measurement, the dispersion liquid for use was prepared by adding 60 mL of 0.5 mass % hexametaphosphoric acid solution to 350 mL of purified water. The concentration of the cellulose particles in the dispersion liquid was 10%. Before the measurement, the dispersion liquid including the cellulose particles was treated for two minutes using an ultrasonic homogenizer. Further, the measurement was performed while the dispersion liquid including the cellulose particles was agitated at an agitating speed of 1500 rpm. The ratio of the length L to the width D of the cellulose particles, that is, the ratio L/D of the cellulose particles, was 6.3, according to the measurement thereof before mixing. The L and D of the cellulose particles were measured in the manner as aforementioned.

Example 2

The glove according to Example 2 was produced in the same manner as in Example 1, except that 10 mass parts of the cellulose particles having an average particle size of 37 μm was added to the second coating liquid based on 100 mass parts of the resin (NBR latex). The ratio L/D of the cellulose particles was 6.3.

Example 3

The glove according to Example 3 was produced in the same manner as in Example 1, except that 15 mass parts of the cellulose particles having an average particle size of 37 μm was added to the second coating liquid based on 100 mass parts of the resin (NBR latex). The ratio L/D of the cellulose particles was 6.3.

Example 4

The glove according to Example 4 was produced in the same manner as in Example 1, except that 20 mass parts of the cellulose particles having an average particle size of 37 μm was added to the second coating liquid based on 100 mass parts of the resin (NBR latex). The ratio L/D of the cellulose particles was 6.3.

Example 5

The glove according to Example 5 was produced in the same manner as in Example 1, except that 30 mass parts of the cellulose particles having an average particle size of 37 μm was added to the second coating liquid based on 100 mass parts of the resin (NBR latex). The ratio L/D of the cellulose particles was 6.3.

Example 6

The glove according to Example 6 was produced in the same manner as in Example 1, except that 40 mass parts of the cellulose particles having an average particle size of 37 μm was added to the second coating liquid based on 100 mass parts of the resin (NBR latex). The ratio L/D of the cellulose particles was 6.3.

Example 7

The glove according to Example 7 was produced in the same manner as in Example 1, except that 20 mass parts of the cellulose particles having an average particle size of 10 μm was added to the second coating liquid based on 100 mass parts of the resin (NBR latex). The ratio L/D of the cellulose particles was 4.3.

Example 8

The glove according to Example 8 was produced in the same manner as in Example 1, except that 20 mass parts of the cellulose particles having an average particle size of 17 μm was added to the second coating liquid based on 100 mass parts of the resin (NBR latex). The ratio L/D of the cellulose particles was 4.0.

Example 9

The glove according to Example 9 was produced in the same manner as in Example 1, except that 20 mass parts of the cellulose particles having an average particle size of 45 μm was added to the second coating liquid based on 100 mass parts of the resin (NBR latex). The ratio L/D of the cellulose particles was 5.8.

Comparative Example 1

The glove according to Comparative Example 1 was produced in the same manner as in Example 1, except that 5 mass parts of the cellulose particles having an average particle size of 37 μm was added to the second coating liquid based on 100 mass parts of the resin (NBR latex). The ratio L/D of the cellulose particles was 6.3.

Comparative Example 2

The glove according to Comparative Example 2 was produced in the same manner as in Example 1, except that no cellulose particles were added to the second coating liquid.

Reference Example 1

As a glove according to Reference Example 1, a commercially available glove was prepared including pile fibers (rayon pile fibers) and having an innermost layer (i.e., layer in contact with the wrist, and the palm and back of the hand of the wearer) formed as a foamed layer.

(Static Contact Angle)

For the glove according to each of Examples and Comparative Examples, the static contact angle $\theta_1$ immediately after a water droplet was brought into contact with the surface of the vapor perspiration suppressing layer, and the static contact angle $\theta_2$ five seconds after a water droplet was brought into contact with the vapor perspiration suppressing layer were measured. The static contact angle $\theta_1$ and the static contact angle $\theta_2$ were measured as follows:

(1) A part of the glove body or a part of the cuff is cut out in a rectangular plane shape having a specific dimension (i.e., rectangular plane shape of 2 cm×4 cm) from a given portion of the glove according to each of Examples and Comparative Examples to obtain a sample.

(2) The sample is allowed to dry in an oven at 100° C. for 30 minutes.

(3) For the sample that has been dried, a water droplet in a specific amount is brought into contact with a matrix resin surface of the vapor perspiration suppressing layer. Specifically, a water droplet in an amount of 25 μL is brought into contact with the matrix resin surface of the vapor perspiration suppressing layer of the sample using a micropipette.

(4) Within a second after the water droplet is brought into contact with the matrix resin surface of the vapor perspiration suppressing layer of the sample, a static contact angle with the water droplet is measured. The static contact angle immediately after the water droplet is brought into contact with the matrix resin surface of the vapor perspiration suppressing layer is measured using a contact angle measuring device "DropMaster500" (manufactured by Kyowa Interface Science Co., Ltd.), and evaluation and analysis software "FAMAS" (manufactured by Kyowa Interface Science Co., Ltd.). The static contact angle immediately after the water droplet is brought into contact with the matrix resin surface of the vapor perspiration suppressing layer is calculated by the θ/2 method.

(5) The static contact angle with the water droplet is measured five seconds after the water droplet is brought into contact with the matrix resin surface of the vapor perspiration suppressing layer of the sample. The static contact angle five seconds after the water droplet is brought into contact with the matrix resin surface of the vapor perspiration suppressing layer is measured in the same manner as in the measurement of the static contact angle immediately after the water droplet is brought into contact with the matrix resin surface of the vapor perspiration suppressing layer.

(6) The steps (1) to (5) are performed for samples cut out from three given portions of the glove according to each of Examples and Comparative Examples (i.e., three samples) to obtain the static contact angle values immediately after the water droplet is brought into contact with the matrix resin surface of the vapor perspiration suppressing layer and the static contact angle values five seconds after the water droplet is brought into contact with the matrix resin of the vapor perspiration suppressing layer for the respective three samples, followed by arithmetically averaging these values respectively to obtain the static contact angle $\theta_1$ and the static contact angle $\theta_2$.

For the glove according to each of Examples and Comparative Examples, the value of the static contact angle $\theta_1$ and the value of the static contact angle $\theta_2$ obtained as above were used to calculate a change rate Rc of the static contact angle with the equation (1) below. Table 3 below shows the value of the static contact angle $\theta_1$, the value of the static contact angle $\theta_2$, and the change rate Rc of the static contact angle obtained for the glove according to each of Examples and Comparative Examples.

$$Rc = \frac{(\theta_1 - \theta_2)}{\theta_1} \times 100 \quad (1)$$

TABLE 3

| | Static contact angle $\theta_1$ [°] | Static contact angle $\theta_2$ [°] | Change rate Rc of static contact angle [%] |
|---|---|---|---|
| Ex. 1 | 58 | 38 | 34 |
| Ex. 2 | 55 | 15 | 73 |
| Ex. 3 | 60 | 14 | 77 |
| Ex. 4 | 60 | 13 | 78 |
| Ex. 5 | 68 | 13 | 81 |
| Ex. 6 | 68 | 9 | 87 |
| Ex. 7 | 59 | 26 | 56 |
| Ex. 8 | 61 | 17 | 72 |
| Ex. 9 | 60 | 10 | 83 |
| C. Ex. 1 | 62 | 50 | 19 |
| C. Ex. 2 | 71 | 60 | 15 |

(Water Migration Properties to Innermost Layer)

Water migration properties to the innermost layer were examined for the glove according to each of Examples 2 and 5 and Comparative Example 2. Water migration properties to the innermost layer were examined as follows:

(1) A part of the glove body or a part of the cuff is cut out in a rectangular plane shape having a specific dimension (i.e., rectangular plane shape of 3 cm×5 cm) from a given portion of the glove according to each of Examples 2 and 5 and Comparative Example 2 to obtain a sample.

(2) The sample is allowed to dry in an oven at 100° C. for 30 minutes.

(3) The sample that has been dried is attached to a semicircular portion of a jig having a semicircular shape in cross section so as to have its innermost layer facing outside, and thereafter the mass of the jig with the sample attached thereto (hereinafter referred to as initial mass $W_0$) is measured.

(4) After a water droplet in an amount of 25 μL is placed in a glass petri dish using a micropipette, the innermost layer of the sample attached to the jig is brought into contact with the water droplet in an amount 25 μL and then removed from the water droplet within a second after the contact.

(5) Within 10 seconds after the innermost layer of the sample is removed from the water droplet, the mass of the jig with the sample attached thereto (hereinafter referred to as after-contact-with-water mass $W_1$) is measured.

(6) The steps (1) to (5) are performed for samples cut out from three given portions of the glove according to each of Examples 2 and 5 and Comparative Example 2 (i.e., three samples) to obtain the initial mass $W_0$ and the after-contact-with-water mass $W_1$ for the respective three samples, followed by using these values to determine the arithmetic average value (Wove) of the initial mass $W_0$ and the arithmetic average value ($W_{1ave}$) of the after-contact-with water mass $W_1$ using these values.

(7) $W_{0ave}$ is subtracted from $W_{1ave}$ to obtain a water migration amount $W_T$ to the innermost layer of the sample.

Table 4 below shows the water migration amount $W_T$ obtained for the sample cut out from the glove according to each of Examples 2 and 5 and Comparative Example 2.

TABLE 4

| | Water migration amount $W_T$ [g] |
|---|---|
| Ex. 2 | 0.033 |
| Ex. 5 | 0.033 |
| C. Ex. 2 | 0.014 |

It is understood from Table 4 that the sample according to each of Examples 2 and 5 having the innermost layer (vapor perspiration suppressing layer) including the cellulose particles has a greater water migration amount $W_T$ value than the sample according to Comparative Example 2 having the innermost layer including no cellulose particles. It is therefore understood that the cellulose particles included in the innermost layer allow perspiration of the wearer to easily migrate to the surface of the innermost layer (vapor perspiration suppressing layer).

The gloves according to Examples, the gloves according to Comparative Examples, and the glove according to Reference Example 1 were evaluated for vapor perspiration properties while the wearer had the glove on and for removability when the glove on the wearer was removed.

(Vapor Perspiration Properties)

Vapor perspiration properties inside the glove while being worn was evaluated as follows:

(1) Ask eight research subjects each to wear the glove according to each of Examples, the glove according to each of Comparative Examples, and the glove according to Reference Example 1.

(2) Ask the eight research subjects to have the glove according to each of these examples on for two hours.

(3) In the state where they have the glove according to each of the examples on for two hours, ask the research subjects to evaluate vapor perspiration in the glove according to the following criteria, and arithmetically average their evaluation results respectively:

4: The research subject does not feel any vapor perspiration inside the glove while having the glove on.

3: The research subject slightly feels vapor perspiration inside the glove while having the glove on, but not to the extent that he or she feels uncomfortable.

2: The research subject feels vapor perspiration inside the glove and feels somewhat uncomfortable while having the glove on.

1: The research subject remarkably feels vapor perspiration inside the glove feels extremely uncomfortable while having the glove on.

Table 5 below shows the evaluation results of vapor perspiration properties.

(Removability)

Removability when the glove on the wearer was removed was evaluated as follows:

(1) Ask eight research subjects each to wear the glove according to each of Examples, the glove according to each of Comparative Examples, and the glove according to Reference Example 1.

(2) Ask the eight research subjects to have the glove according to each of these examples on for two hours.

(3) After they have the glove according to each of the examples on for two hours, ask the research subjects to remove the glove according to each of the examples and evaluate its removability when the glove on the wearer is removed according to the following criteria, and arithmetically average their evaluation results respectively:

4: The research subject can extremely easily remove the glove without feeling his or her hand caught on the innermost layer.

3: The research subject slightly feels his or her hand caught on the innermost layer, but can relatively easily remove the glove.

2: The research subject feels his or her hand caught on the innermost layer, and finds it somewhat difficult to remove the glove.

1: The research subject feels his or her hand extremely significantly caught on the innermost layer, and finds it extremely difficult to remove the glove.

Table 5 below shows the evaluation results of removability.

TABLE 5

| | No. of parts of cellulose particles [parts] | Vapor perspiration properties | Removability |
|---|---|---|---|
| Ex. 1 | 7.5 | 3 | 3 |
| Ex. 2 | 10.0 | 4 | 4 |
| Ex. 3 | 15.0 | 4 | 4 |
| Ex. 4 | 20.0 | 4 | 4 |
| Ex. 5 | 30.0 | 4 | 3 |
| Ex. 6 | 40.0 | 3 | 3 |
| Ex. 7 | 20.0 | 3 | 3 |
| Ex. 8 | 20.0 | 3 | 3 |
| Ex. 9 | 20.0 | 3 | 3 |
| C. Ex. 1 | 5.0 | 1 | 2 |
| C. Ex. 2 | 0.0 | 1 | 1 |
| Ref. Ex. 1 | — | 1 | 1 |

Table 5 shows that the glove according to each of Examples was evaluated favorably both for vapor perspiration properties while the wearer had the glove on, which was scored 3 points or more, and for removability when the glove on the wearer was removed, which was scored 3 points or more. In particular, the glove according to each of Example 2 to Example 4 was evaluated extremely favorably both for vapor perspiration properties while the wearer had the glove on, which was scored 4 points or more, and for removability when the glove on the wearer was removed, which was scored 4 points or more. In contrast, the glove according to Comparative Example 1 to which 5 mass parts of the cellulose particles were added was evaluated unfavorably both for vapor perspiration properties while the wearer had the glove on, which was scored 1 point, and for removability when the glove on the wearer was removed, which was scored 2 points. The glove according to Comparative Example 2 to which no cellulose particles were added was evaluated extremely unfavorably both for vapor perspiration properties when the wearer had the glove on, which was scored 1 point, and for removability when the glove on the wearer was removed, which was scored 1 point. Further, the glove according to Reference Example 1 in which the innermost layer was a foamed layer was evaluated extremely unfavorably both for vapor perspiration properties while the wearer had the glove on, which was scored 1 point, and for removability when the glove on the wearer was removed, which was scored 1 point.

REFERENCE SIGNS LIST

1: Glove
10: Glove body
20: Cuff
30: Resin layer
40: Vapor perspiration suppressing layer
40*a*: Cellulose particles
40A: Projection
40B: Recess

What is claimed is:

1. A glove comprising a glove body configured to cover a hand of a wearer, wherein the glove body comprises: a resin layer forming an outer surface of the glove; and an innermost layer comprising a matrix resin and cellulose particles and laminated on one surface of the resin layer to form an inner surface of the glove, at least some of the cellulose particles are at least partially exposed from the inner surface, the innermost layer is formed over an entire area of the one surface of the resin layer, and includes 7 mass parts or more and 45 mass parts or less of the cellulose particles based on 100 mass parts of the matrix resin, and is formed as a non-foamed layer, and the cellulose particles have an average particle size of 10 μm or more and 45 μm or less.

2. The glove according to claim 1, wherein the innermost layer includes 8 mass parts or more and 25 mass parts or less of the cellulose particles based on 100 mass parts of the matrix resin.

3. The glove according to claim 1, wherein a change rate Rc of a static contact angle calculated with an equation (1) below is 20% or more and 90% or less:

$$Rc = \frac{(\theta_1 - \theta_2)}{\theta_1} \times 100 \quad (1)$$

where $\theta_1$ represents a static contact angle immediately after a water droplet is brought into contact with a surface of the innermost layer, and $\theta_2$ represents a static contact angle five seconds after the water droplet is brought into contact with the surface of the innermost layer.

4. The glove according to claim 2, wherein a change rate Rc of a static contact angle calculated with an equation (1) below is 20% or more and 90% or less:

$$Rc = \frac{(\theta_1 - \theta_2)}{\theta_1} \times 100 \quad (1)$$

where $\theta_1$ represents a static contact angle immediately after a water droplet is brought into contact with a surface of the innermost layer, and $\theta_2$ represents a static contact angle five seconds after the water droplet is brought into contact with the surface of the innermost layer.

* * * * *